US009475184B2

(12) United States Patent
Balestrieri

(10) Patent No.: US 9,475,184 B2
(45) Date of Patent: Oct. 25, 2016

(54) TELESCOPIC ROD FOR HANDLING A TOOL

(71) Applicant: FUEGO INVEST & FINANCE CORP., Road Town (VG)

(72) Inventor: Rita Balestrieri, Cureglia (CH)

(73) Assignee: FUEGO INVEST & FINANCE CORP., Road Town (VG)

( * ) Notice: Subject to any disclaimer, the term of this patent is extended or adjusted under 35 U.S.C. 154(b) by 0 days.

(21) Appl. No.: 14/422,996

(22) PCT Filed: Sep. 9, 2013

(86) PCT No.: PCT/EP2013/068650
§ 371 (c)(1),
(2) Date: Feb. 20, 2015

(87) PCT Pub. No.: WO2014/082767
PCT Pub. Date: Jun. 5, 2014

(65) Prior Publication Data

US 2015/0246440 A1 Sep. 3, 2015

(30) Foreign Application Priority Data

Sep. 7, 2012 (EP) ..... 12075099

(51) Int. Cl.
*B25G 1/04* (2006.01)

(52) U.S. Cl.
CPC ..... *B25G 1/04* (2013.01); *Y10T 16/473* (2015.01)

(58) Field of Classification Search
CPC ..... B25G 1/04; A01G 3/0255; A01G 3/08; A01G 3/0335; Y10T 16/473; B25J 1/04
USPC ..... 16/429; 81/489; 30/296.1; 294/210; 15/144.4
See application file for complete search history.

(56) References Cited

U.S. PATENT DOCUMENTS 1,789,824 A * 1/1931 Lowe ..... A01G 3/0255 30/251
4,654,971 A * 4/1987 Fettes ..... A01G 3/08 30/296.1

(Continued)

FOREIGN PATENT DOCUMENTS

CN 201878552 U 6/2011
DE 3719811 A1 12/1988

(Continued)

OTHER PUBLICATIONS

International Search Report mailed Jun. 25, 2014, corresponding to International Patent Application PCT/EP2013/068650.

*Primary Examiner* — William Miller
(74) *Attorney, Agent, or Firm* — Ladas & Parry LLP

(57) ABSTRACT

A telescopic rod in order to use objects or tools at a desired height above the head of a user, in particular for harvesting fruit from trees or for pruning tree branches or painting high walls or ceilings, comprises a rod base with a base end, a rod extension slidingly engaging with the rod base, a support member configured to support a tool, arranged at a support end of the rod extension opposite to the rod base, an actuation means to automatically push/pull the rod extension with respect to the rod base, a rod actuation command at said base end to operate the actuation means between a push position, in which the actuation means pushes said rod extension to elongate said rod, a pull position, in which the actuation means pulls the rod extension to shorten the rod, a standby position in which the actuation means is inoperative and the rod can be used at a desired rod length to maneuver the tool at a desired height.

21 Claims, 6 Drawing Sheets

(56) References Cited

U.S. PATENT DOCUMENTS

| | | | | |
|---|---|---|---|---|
| 4,760,646 | A | 8/1988 | Siegler | |
| 4,924,573 | A | 5/1990 | Huddleston | |
| 4,991,298 | A * | 2/1991 | Matre | A01G 3/08 30/166.3 |
| 5,084,975 | A * | 2/1992 | Melter | A01G 3/025 30/245 |
| 5,881,601 | A | 3/1999 | Hammer | |
| 5,960,546 | A * | 10/1999 | Cooke | A01G 3/0255 30/188 |
| 6,038,773 | A * | 3/2000 | Le | A01G 3/0255 30/245 |
| 6,588,065 | B1 * | 7/2003 | Tucker, III | B25G 1/04 16/426 |
| 7,331,077 | B1 * | 2/2008 | Henry | A46B 5/0033 15/23 |
| 7,703,211 | B1 | 4/2010 | Kirchhoff | |
| 9,009,921 | B1 * | 4/2015 | Ramsey | E04D 13/0765 16/429 |
| 2005/0193511 | A1 * | 9/2005 | St. James | B25G 1/04 15/144.4 |
| 2015/0135454 | A1 * | 5/2015 | Conway | B25G 1/04 15/144.4 |

FOREIGN PATENT DOCUMENTS

| | | | |
|---|---|---|---|
| EP | 2216143 | A2 | 8/2010 |
| GB | 2445928 | A | 7/2008 |
| KR | 20040072307 | A | 8/2004 |

* cited by examiner

FIG.7
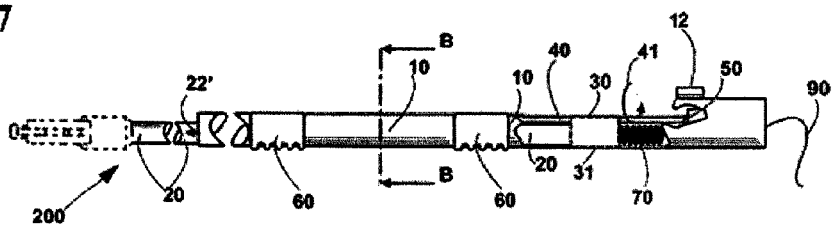
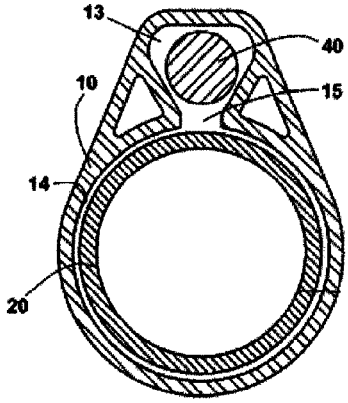
FIG.8
B-B
FIG.9
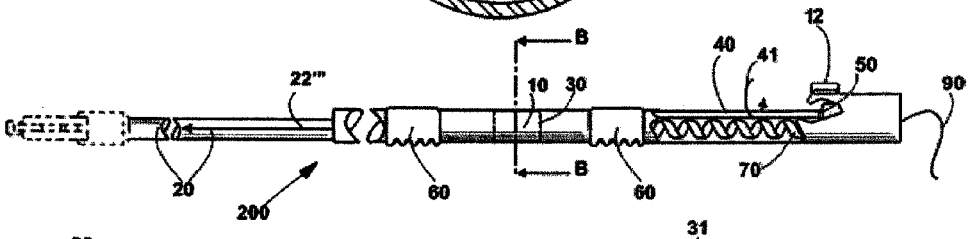
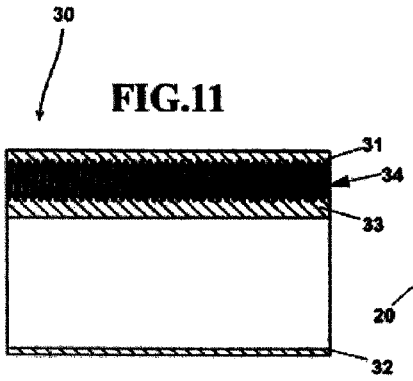
FIG.11
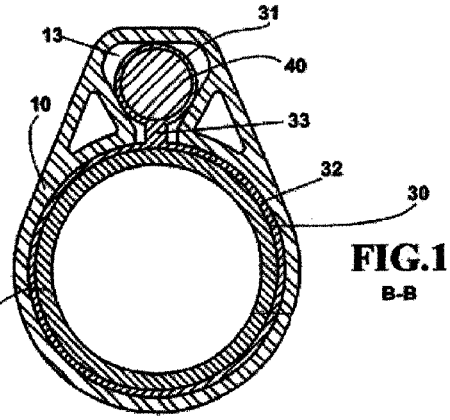
FIG.10
B-B FIG.12
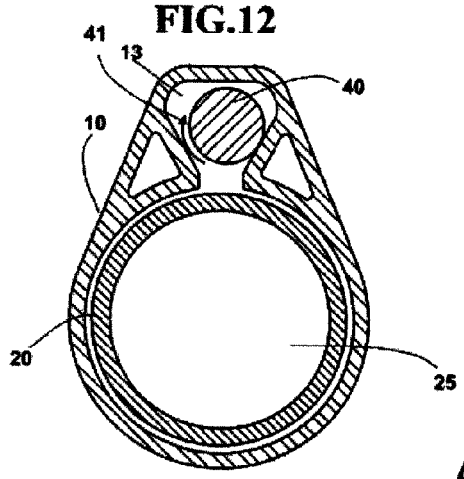
FIG.13
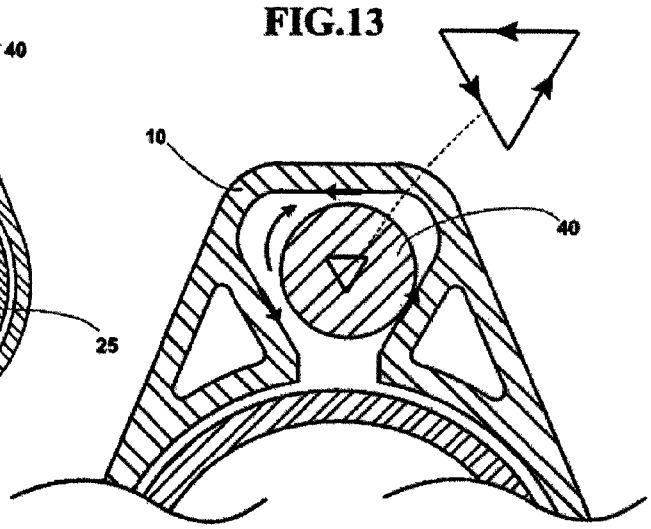
FIG.14
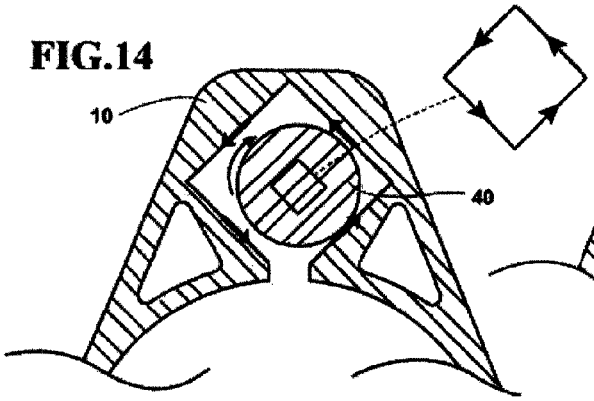
FIG.15
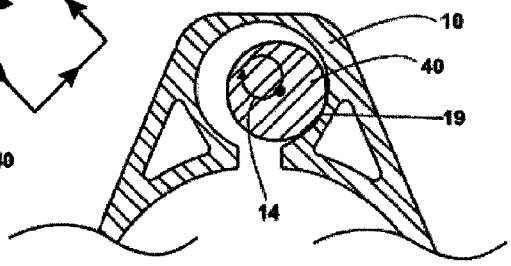
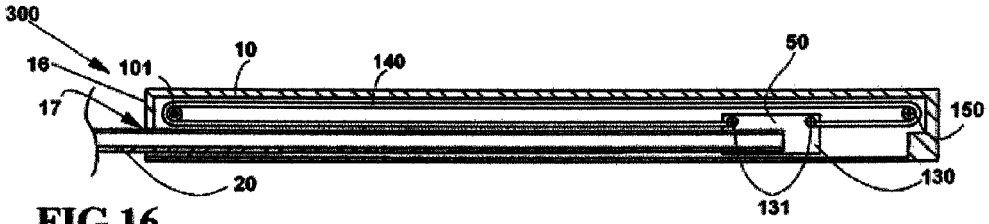
FIG.16
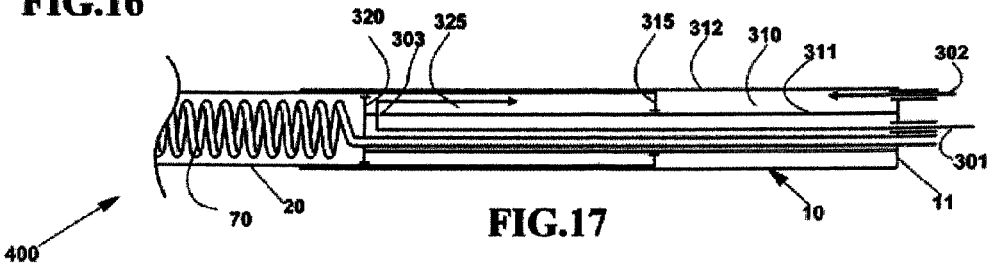
FIG.17

TELESCOPIC ROD FOR HANDLING A TOOL

FIELD OF THE INVENTION

The present invention relates to a telescopic rod for handling a tool, for example for household or industrial use, or for agricultural use, for example an elongated handle, in particular to operate an harvesting or a cutting tool at a desired height above the head of a user.

The rods of this type have a gripping end which can be gripped by a user, and a holding end, where the tool can be supported, in such a way that the user can bring the tool to a desired location above the head of a user by the rod. The rod has a gripping rod member and a holding rod member, which are engaged in a telescopic way with each other.

BACKGROUND OF THE INVENTION

Telescopic rods of the above mentioned type are known of many kinds. They differ from each other in the way for which they are arranged to increase or reduce their length and in the way for which they are locked/released at a desired length.

They can be used for handling a tool at a desired height above the head of a user, such as tools for harvesting fruit from trees, for cutting tree branches, for painting or brushing ceiling or side walls, for collecting objects from high shelves or closets, or for hanging objects at a desired height, etc.

The telescopic rods for these applications should be very light to permit a user to hold them easily and for a long working time, for example a whole day, and at the same time sufficiently stiff, to hold a tool which may be a motorised tool.

Powered telescopic rods are known for heavy duties, such as for raising loads, for moving working platforms or big tools, telescopic masts. Normally they are powered by hydraulic or pneumatic cylinders. However, hydraulic or pneumatic cylinders would be too bulky and heavy to power telescopic rods for the above applications.

Telescopic rods, also known for harvesting fruit or for cutting branches, have at an end a powered tool and a motor, as for example described in CN201878552. At the other end an electric power supply can be connected, for example a battery. The rod can be elongated or shortened manually and an extensible electrical connection is provided between the gripping end and the tool end, in order to supply the motor of the tool at any length of the rod.

Telescopic rods are also known, as for example described in KR20040072307, for harvesting fruit or for cutting branches that have at an end a tool. At the other end they have a transmission means for transmitting the power to the tool. The rod can be elongated or shortened manually, permitting to transmit the power to the tool at any desired length of the rod.

The steps of manually extending or shortening the telescopic rod require the user to lay the rod on a plane, for example on the ground, to unlock the sliding of the rod, to elongate/shorten the rod, to lock the sliding of the rod and then to raise the rod and operate the tool at the desired height.

However, it is desirable that the rod can be elongated/shortened when it is raised, in order to see directly when the tool is at the desired height from the ground and to avoid problematic steps of laying the rod on the ground, elongating/shortening it and then raising it again.

Telescopic rods are also known for example disclosed in U.S. Pat. No. 5,881,601 depicting an extensible rod which can carry out the extension retraction either manually or aided by a motor. The transmission between the fixed and movable part of the extensible rod comprises a rack. An intermediate member comprises gears that engage with the racks, permitting a relative movement of the two parts. The presence of racks and gears determines risk of jamming and blocking the relative movement, and therefore frequent maintenance.

U.S. Pat. No. 4,924,573 discloses an extensible rod with a screw operation. More precisely, a pruner is disclosed which has a fixed hollow base and a hollow rod extension slidingly engaging with the rod base. An actuation worm drive housed within the hollow base engages with a rack mounted to the rod extension. A motor transmission causes the worm to rotate, and a shift lever causes a gearbox to switch the rotation direction of the worm drive, in order to cause the rod extension to extend or to withdraw.

A disadvantage of the pruner disclosed in U.S. Pat. No. 4,924,573 is that, in order to increase the length of the rod extension, also the worm drive has to be correspondingly long. However, a long worm drive would vibrate transversally very intensely and would hit against the housing within the hollow base and also with the rod extension, disengaging from the rack. This would cause rapid wear and break of the worm drive. For this reason the disclosed pruner cannot be made with a long extension, unless reinforcing very heavily the cross section of the worm drive and of the other components, and then over sizing the whole rod and the weight of the parts and of all the device.

Another limit is that the worm drive rotation has to be significantly limited, to avoid the transversal vibration. However, this causes the extension/withdrawal speed to be very low, with a loss of most of the advantages of having a motorised telescopic rod.

SUMMARY OF THE INVENTION

It is therefore a feature of the present invention to provide a telescopic rod for raising a small object, such as a tool, in which the transmission of the movement of the extension rod has limited vibrations, and therefore low wear and high reliability.

It is another feature of the present invention to provide such a telescopic rod with which the object can be raised and lowered very quickly, without damaging the parts of the device.

It is, furthermore, a feature of the present invention to provide a telescopic rod for raising small objects that is light and easy to use.

It is, furthermore, a feature of the present invention in which a worm drive that can be used for extending/shortening the rod can be very light and cheap, for example of a plastic material.

These and other objects are achieved by a telescopic rod for raising small objects comprising:

a rod base having a base end;

a rod extension slidingly engaging with the rod base;

a support member arranged at a support end of the rod extension opposite to the rod base, the support member configured to support a tool;

an actuation means arranged to push/pull automatically the rod extension with respect to the rod base;

a rod actuation command arranged at the base end to operate the actuation means between:

a push position, in which the actuation means pushes the rod extension with respect to the rod base in order to elongate the telescopic rod;

a pull position, in which the actuation means pulls the rod extension with respect to the rod base in order to shorten the telescopic rod;

a standby position in which the actuation means is inoperative and the telescopic rod can be used at a desired rod length to manoeuvre the tool at a desired height.

According to an aspect of the invention, said actuation unit comprises:

a nut element integral to said rod extension, and a longitudinal screw member that pivotally engages with said rod base.

a motor means that causes said screw member to rotate upon operation by said rod actuation command, wherein said nut element is arranged to slide within said rod base and to engage with said screw member in such a way that upon rotation of said screw member said rod extension slides within said rod base, and wherein said rod base has a longitudinal channel in which said screw member engages with play, wherein said longitudinal channel has a polygonal shaped cross-section.

This way, even in the presence of play between the screw member and the channel, rolling vibrations of the screw member in the longitudinal channel is avoided. This advantage of using a polygonal shaped cross-section for the longitudinal channel will be discussed hereinafter.

Advantageously, said polygonal shaped cross-section of said longitudinal channel is a triangular cross-section.

Alternatively, said polygonal shaped cross-section of said longitudinal channel is a square cross-section.

Preferably, said polygonal shaped cross-section of said longitudinal channel is configured relatively to said screw member in such a way that said longitudinal channel has an inner size (D) corresponding to a diameter (D') of said screw member with a predetermined play.

In particular, said predetermined play provides said inner size (D) that is greater than the outer diameter (D') of said screw member from 0.5 mm to 4 mm, in particular from 1 mm to 2 mm.

Advantageously the actuation means is configured to lock the rod extension with respect to the rod base when the rod actuation command is in the standby position. In this way, the rod extension cannot slide in the rod base when the rod has a desired length under the load of the tool or under actions caused by the operation of the tool.

Preferably, said rod base can have a tubular shape with an inner longitudinal chamber, and said nut element has a collar for embracing said rod extension, and said collar slides within said inner longitudinal chamber of said rod base. This way, the rod extension is embraced by the collar, which slides in the rod base, so that the rod extension does not contact the rod base except from the collar, with minimum friction for its translation within the rod base.

In particular, said nut element can be connected to rod extension by a neck, and between said longitudinal channel and said inner longitudinal chamber of said rod base a groove is provided in which said neck slides. This way, the nut element can slide in a guided manner by the neck, with minimum friction, and the rod base can be made as a single piece, for example by extrusion of aluminium or plastics.

Advantageously, said channel has a width less than the diameter of said screw member. This way, any transversal vibration of the screw member cannot cause the screw member to exit from the channel and to touch the rod extension or the rod base.

In view of the above, a very light and low-cost material can be used to build the screw member and the rod base which is useful for limiting the cost and the weight of the telescopic rod. In fact, the polygonal cross section of the channel and the play between channel and screw member avoid contact between them and reduces the wear.

Advantageously, the support member is configured to support a motorised tool and an extensible connection is arranged between the base end and the support end in order to provide a power supply at the support end to power the motorised tool at any relative position between the rod extension and the rod base.

Preferably, a tool command is provided at the base end of the rod base, eventually connected to an extensible connection to turn on/off the motorised tool.

In a second aspect of the invention, the actuation means that is arranged to push/pull automatically the rod extension with respect to the rod base comprises a tendon that has an anchoring point fixed to the rod extension. An idle pulley and a motorised pulley are provided which pivotally engage with the rod base, and a housing channel is provided in the rod base to protect the pulleys. This way, the single tendon can be used as push/pull member, and the actuation can be light and easy to operate.

In a third aspect of the invention, the actuation means is arranged to push/pull automatically the rod extension with respect to the rod base end comprises a pneumatic or hydraulic actuation means, with a first fluid passage and a second fluid passage on the rod base, and a command valve, for selectively entering fluid into the first fluid passage or into the second fluid passage. The rod base and the rod extension are arranged in such a way that fluid selectively entered in the first annular chamber or in the second annular chamber causes a relative movement of the rod extension with respect to the rod base in order to elongate or shorten the telescopic rod.

In this case, the rod base forms an annular chamber communicating with the first fluid passage and the rod extension forms a second annular chamber, communicating with the second fluid passage. The rod base has an internal tube connected to a steady flange. The rod extension has a flanged portion slidingly and tightly engaging with the inner cylindrical wall of the rod base and with the outer wall of the inner tube. In the second annular chamber an opening on the internal tube is realized at the opposite end to that fitted on the rod base end, corresponding to the second fluid passage. In this way, the fluid entered though the second fluid passage enters the internal tube, passes through the opening and enters the second annular chamber pushing on one side of the flanged portion causing the telescopic rod to shorten, whereas fluid entered through the first fluid passage enters the first annular chamber and pushes the other side of the flanged portion, causing the rod extension, connected to this flange, to elongate. A command valve is provided to enter selectively fluid through the first or the second passage, or to lock fluid in the both respective chambers, causing the telescopic rod to remain locked at a desired length. Advantageously, an anti-rotation means is provided to prevent a rotation of the rod extension with respect to the rod base.

In a first possible embodiment, the anti-rotation means comprises a protrusion or a recess made along an external wall of the rod extension, and a recess or a protrusion, respectively, made along an inner wall of the rod base, the protrusion and the recess adapted to engage with each other and to avoid a relative rotation of the rod extension respect to the rod base.

Alternatively, the same cylindrical actuation means previously described, free to rotate, can be realized with a small diameter (for example with a diameter of only 20 mm and a pressure of 6 bar the forces can be more than enough) and be housed in a traditional telescopic system in which the same non-circular profile of the two steady and sliding parts guarantees the anti-rotation.

BRIEF DESCRIPTION OF THE DRAWINGS

The invention will be now shown with the description of an exemplary embodiment thereof, exemplifying but not limitative, with reference to the attached drawings, wherein:

FIG. 7 is the telescopic rod of FIG. 2-3 in an operative position and FIG. 8 is a cross-section of according to arrows B-B of FIG. 7;

FIG. 9 is the telescopic rod of FIG. 2-3 in another operative position and FIG. 10 is a cross-section of according to arrows B-B of FIG. 9;

FIG. 11 is a longitudinal cross-section of a nut element of a screw mechanism of a telescopic rod according to FIGS. 2-10.

FIG. 12 is a cross-sectional view similar to FIG. 8 of the engagement with play of a screw member with a longitudinal channel and FIG. 13 is an enlarged partial view thereof;

FIGS. 14 and 15 are cross-sectional partial views similar to FIG. 13 but related to different embodiments of the shape of the channel;

FIG. 16 shows a different embodiment of the actuating means of the telescopic rod, operated by a motorised tendon;

FIG. 17 shows a further different embodiment of the actuating means of the telescopic rod, comprising a pneumatic or hydraulic means;

DESCRIPTION OF PREFERRED EXEMPLARY EMBODIMENTS

Figure 1:
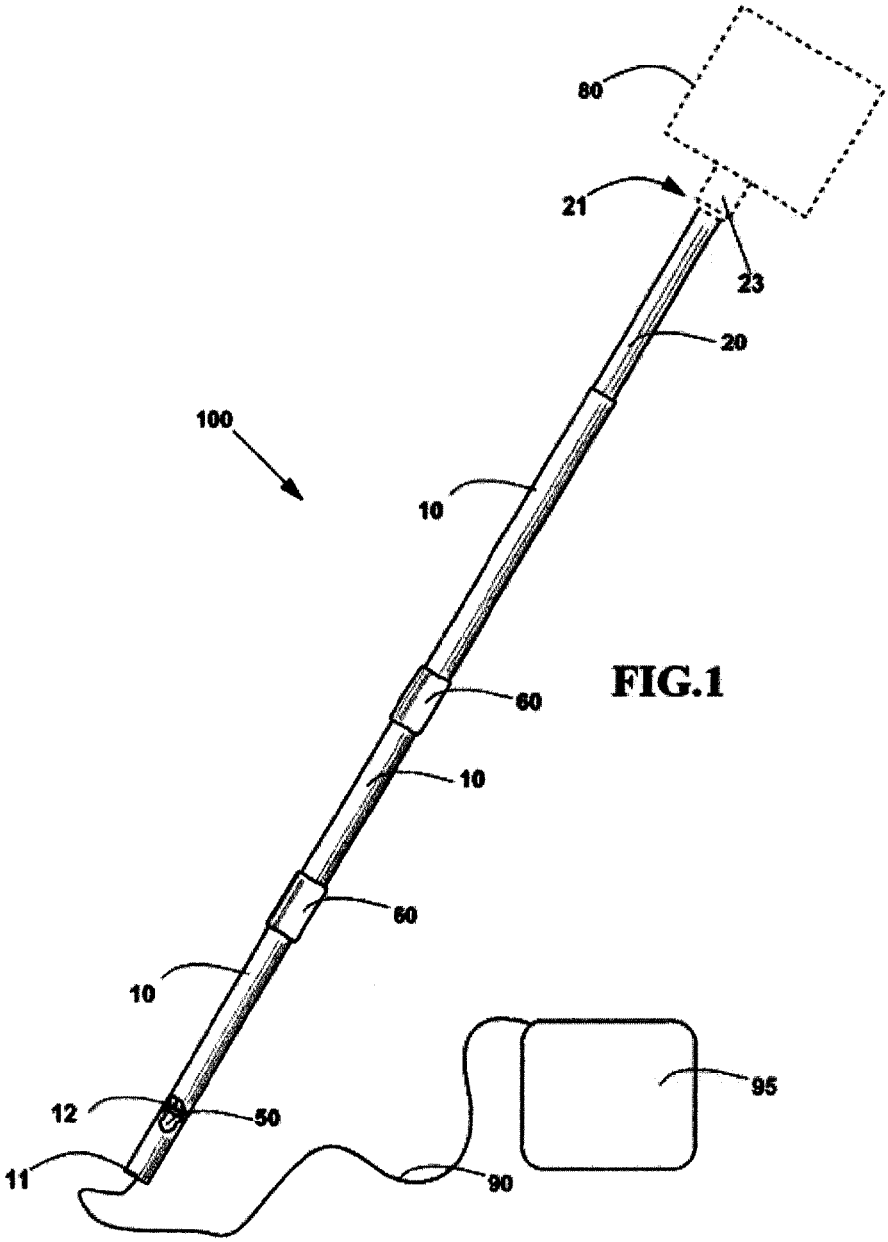
FIG. 1 is a diagrammatical view of a telescopic rod for handling a tool according to the invention.

With reference to FIG. 1, a telescopic rod 100 for raising a small object 80 comprises a rod base 10, which has a base end 11, and a rod extension 20 that slidingly engages with rod base 10.

A support member 23 is provided arranged at a support end 21 of rod extension 20 opposite to rod base 10. In particular, support member 21 is configured to support a tool 80, which can be any tool that has to be operated at a desired height over the head of a user. The tool can be a harvesting tool, a cutter for example for high pruning, a tool for working on high walls or ceilings, for example a painting tool.

In relation to the different position reached by rod extension 20 with respect to rod base 10, telescopic rod 100 reaches a different length, and tool 80 can be raised and handled by telescopic rod 100 over the head of a user, not shown, at a different height.

According to the invention, an actuation means 50 is arranged to push/pull automatically rod extension 20 with respect to rod base 10. In order to operate actuation means 50, a rod actuation command 12 is arranged proximate to base end 11.

Figure 5:
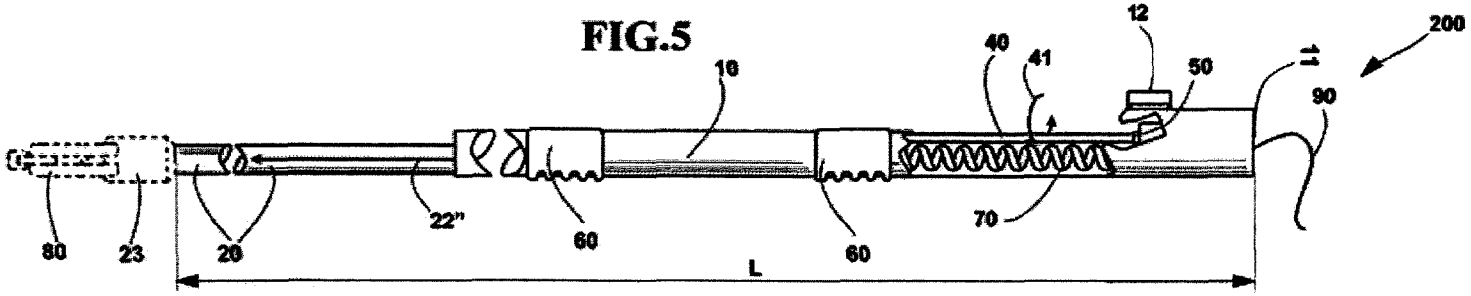

In particular, rod actuation command 12 is configured to operate actuation means 50, and can take:

a push position, in which actuation means 50 pushes rod extension 20 with respect to rod base 10 in order to elongate rod 100, a pull position, in which actuation means 50 pulls rod extension 20 with respect to rod base 10 in order to shorten telescopic rod 100, and a standby position, in which actuation means 50 is inoperative and rod base 10 can be used at a desired rod length L (FIG. 5) to manoeuvre tool 80 at a desired height (FIG. 5).

Preferably, actuation means 50 is configured to lock rod extension 20 with respect to rod base 10 when rod actuation command 12 is in the standby position. The fact that the actuation means locks the position is very useful, because no additional lock means are required, which should be manually operated or additional automatic lock means should be added.

In an exemplary embodiment, support member 23 is configured to support a motorised tool 80. In this case, an extensible connection 70 (FIGS. 3-6) may be arranged between base end 11 and support end 21, in order to provide a power supply at support end 21 to power motorised tool 80 at any relative position between rod extension 20 and rod base 10. In particular, the extensible connection can be a coil arranged between rod extension 20 and rod base 10.

In this case, a tool command 95 is preferably provided at base end 11, eventually connected by a generic connection means 90 to turn on/off motorised tool 80. In particular, a multiple command can be provided that comprises the rod actuation command and the tool command.

Advantageously, at least two handle portions 60 are provided along rod base 10. In particular telescopic rod 10 of FIG. 1 has two sleeve handles 60 fixed, or slidable along rod base 10, for the grip of the hands of the user when handling the rod in order to manoeuvre the tool.

Figure 2:
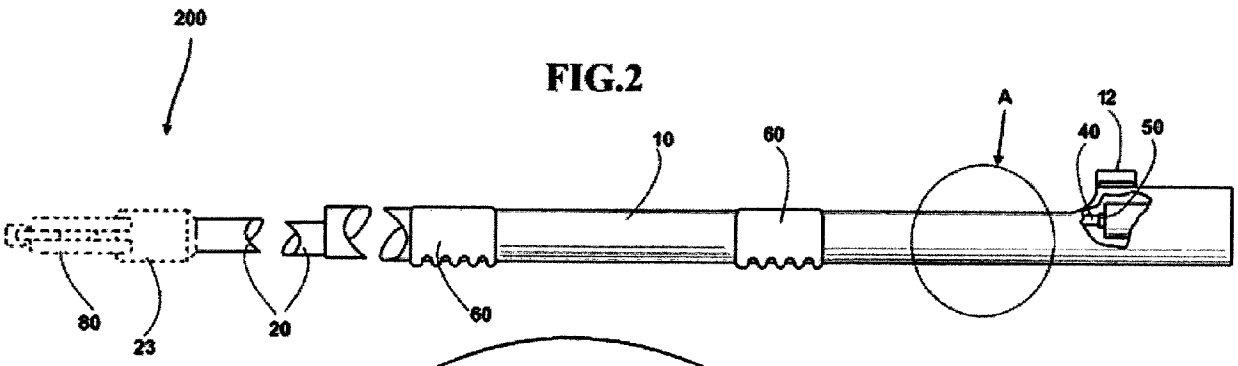
FIG. 2-3 is a diagrammatical view of a first embodiment, of the telescopic rod of the invention, with rod extension moved by a screw mechanism.
Figure 3:
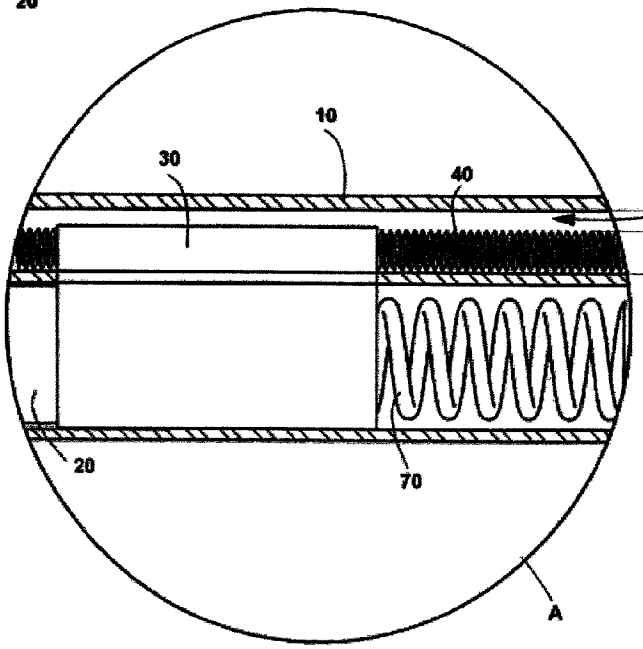

With reference to FIGS. 2 and 3, in a preferred exemplary embodiment of the invention, a telescopic rod 200 comprises a screw mechanism 30-40 to move rod extension 20 with respect to rod base 10. For instance, actuation means 50 may comprise a nut element 30 integral to rod extension 20, and a longitudinal screw member 40 that pivotally engages with rod base 10. This is shown more in detail in the partial longitudinal cross-sectional view of FIG. 3, along with extensible connection 70, which is optional in this preferred exemplary embodiment.

Actuation means 50 may comprise a motor means that causes screw member 40 to rotate upon operation by rod actuation command 12, according to a sense of rotation 41.

In an embodiment of the invention, nut element 30 can be arranged to slide in rod base 10 and to engage with screw member 40 in such a way that, upon rotation of screw member 40 according to rotation sense 41, or according to a rotation sense opposite to rotation sense 41, rod extension 20 slides within rod base 10 according to a slide direction 31 of nut element 30 to elongate telescopic rod 200, or to a slide direction opposite to direction 31 to shorten telescopic rod 200, respectively.

Figure 4:
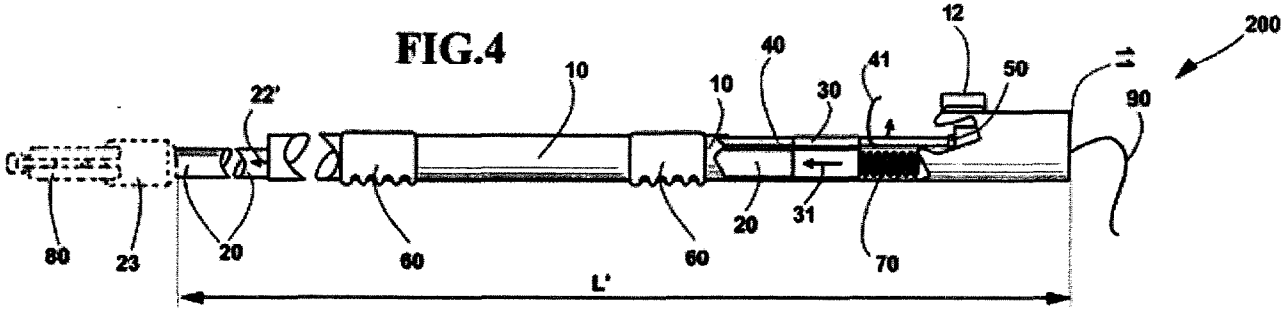
FIG. 4-6 are partially cross-sectional views of the telescopic rod, of FIG. 2 in three operative positions.
Figure 6:
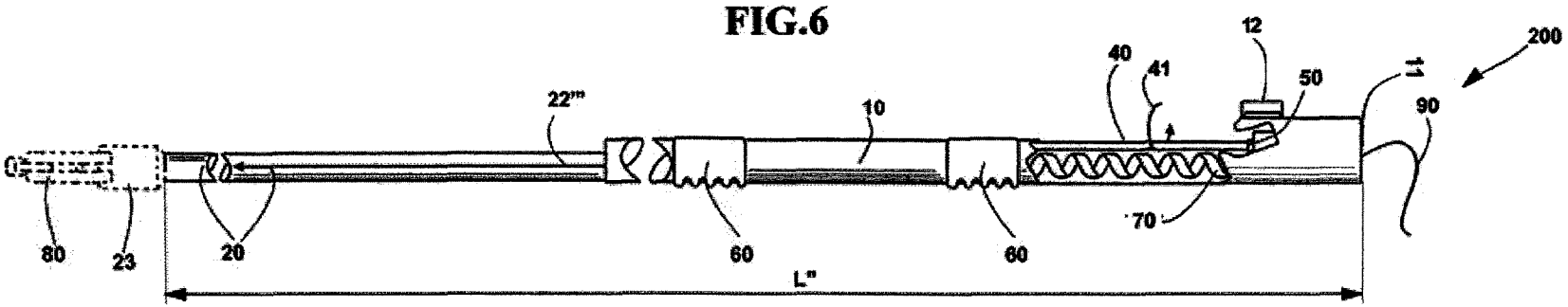

Telescopic rod 200 of FIGS. 2 and 3 is shown in three different configurations in FIGS. 4-6. In FIG. 4, a retracted configuration of telescopic rod 200 is shown, in which nut element 30 is at a position closer to base end 11 of rod base 10, rod extension 20 is retracted within rod base 10, and telescopic rod 200 has a minimum length L'. In FIG. 6, a fully extended configuration is shown, in which nut element 30 is at a farther position, not shown, from base end 11, rod extension 20 is substantially fully elongated out of rod base 10, and telescopic rod 200 is at a maximum length L". In FIG. 5, an intermediate position is shown, in which nut element 30 is at an intermediate distance from base end 11, rod extension 20 has an intermediate elongation out of rod base 10, and telescopic rod 200 has an operating length L intermediate between minimum length L' and maximum length L".

Still with reference to FIG. 3, rod base 10 has a longitudinal channel 13 in which screw member 40 engages with play, in particular, channel 13 have an inner size D that corresponds to the diameter D' of screw member, in particular with a play between preferably from 0.5 mm to 4 mm, in particular from 1 mm to 2 mm.

In a preferred embodiment, longitudinal channel 13 has a shaped cross-section, in particular a polygonal cross-section selected among a triangular or square, (FIG. 12-14) cross-section. Most preferably, as shown for instance in FIGS. 8, 10, 12 and 13 longitudinal channel 13 has a substantially triangular cross-section.

In the polygonal cross section any transversal vibration of the screw member would cause a hit of the screw member with the internal polygonal flat faces of the longitudinal channel. However, between a contact with a face and another face, a detachment of the screw member from the inner surface of the channel would occur, reducing the wear and also avoiding that the screw member is subject to torque by rolling within the channel, and the to serious wear and heating, up to breaking. This technical effect is remarkably higher in case of the square cross section, and even more in case of the triangular cross section.

The cross-sectional view of FIG. 15 shows, instead, a round, substantially circular cross-section. The advantages of a shaped, cross-section of longitudinal channel 13 will be discussed hereinafter. Also this solution can be advantageous, owing to the engagement with play.

FIGS. 7 and 9 show longitudinal, partially sectional views of telescopic rod 200 in a less elongated configuration and in a more elongated configuration, respectively. In these two configurations of rod 200, rod extension 20 along with nut element 30 has two different positions along rod base 10. FIGS. 8 and 10 show two cross-sectional views of telescopic rod 200 taken at a same cross-section B-B of rod base 10. In the more elongated configuration of FIGS. 9 and 10, section plane B-B cuts nut element 30. On the contrary, in the less elongated configuration of FIGS. 7 and 8, nut element 30 is far away from section plane, therefore nut element 30 cannot be seen in FIG. 10.

In particular, rod base 10 is a tubular member, and has an inner longitudinal chamber 14, which can be seen in FIG. 8. As shown in FIG. 11, nut element 30 has a nut portion 31 in which a through screw hole 34 is adapted to engage with screw member 40, and a collar 32 for embracing rod extension 20. Collar 31 is adapted to slide within inner longitudinal chamber 14 of rod base 10. Still with reference to FIG. 11, nut portion 31 of nut element 30 is connected to collar 32 by a neck 33. Between channel 14 and inner longitudinal chamber 13 (FIG. 8) of rod base 10, a groove is present in which neck 32 can slide.

FIG. 12 is a cross-sectional view like cross-sectional view of FIG. 8, in which screw member 40 is shown in an offset position with respect to longitudinal channel 13 of rod base 10. This corresponds to what is likely to happen during the operation of actuation where portions of screw member 40 are away from nut element 30 and may have contact with a wall of longitudinal channel 13 due to vibrations, own weight and torque, etc. FIG. 13 shows a detail of the cross-sectional view of FIG. 12, while FIGS. 14 and 15 show with the same magnification a similar behaviour of screw member 40 in a longitudinal channel that has a square or a substantially circular cross-section, respectively.

In the case (FIG. 15) of a circular cross-section (the more intuitive) this play would generate vibration, especially at high rotation speed, very strong and unacceptable. Indeed, given the considerable length and the inevitable flexibility of the screw, it will have surely contact at random points with the longitudinal channel 13 of rod base 10. In these points the slight centrifugal force due to eccentric rotation pushes the screw to adhere to the wall of the longitudinal channel 13 forcing the screw, rather than to slip, to roll inside it with a circular path, in the opposite direction to the rotation. Given the little diameter differences, at every turn of the screw corresponds many more rounds of this circular movement. It therefore triggers a circular oscillation at very high frequency, which causes intense centrifugal forces which enhance this adhesion and exacerbates the phenomenon, making it unacceptable.

On the contrary, in the case of the polygonal cross-section of FIG. 13 or 14, any initial adhesion force generates a trajectory of small straight line segments which, as such do not generate any additional centrifugal force, therefore not increases initial adhesion and not amplifies the small initial forces.

This is also particularly important if the members which come into contact are made of a light, delicate and inexpensive material, such as a common plastic material, which is the most preferred choice and at the same time it limits the cost and the weight of the telescopic rod.

FIG. 16 shows a partial longitudinal sectional view of a telescopic rod 300 according to another exemplary embodiment of the invention. Telescopic rod 300 comprises a rod base 10 and a rod extension 20 that slidingly engages with rod base 10 and is partially housed in a longitudinal housing 140 defined by rod base 10. A tool-side portion of rod extension 20 protrudes out of rod base 10 through a an opening 17 made through a top wall i.e. end wall 16 of rod base 10. Rod extension 20 is integrally arranged on a slide element 130, which is slidably arranged inside longitudinal housing 140 within rod base 10.

Actuation means 50 of telescopic rod 300 comprises a tendon 140 that has two anchoring points 131 fixed to slide element 130. Tendon 140 is held between two pulleys 101,150, in particular between an idle pulley 101 and a motorised pulley 150 which pivotally engage with rod base 10. By rotating motorised pulley 150 clockwise or counter-clockwise, slide element 130 is caused to slide towards or away from opening 17, and the protruding portion of rod extension 20 is lengthened or shortened, respectively, which increases or decreases the length of telescopic rod 300.

FIG. 17 shows a telescopic rod 400 according to a further exemplary embodiment of the invention, which comprises a pneumatic or hydraulic actuation means.

The pneumatic or hydraulic actuation means comprises a first fluid passage 301 and a second fluid passage 302 made through a wall of the rod base. In the telescopic rod partially shown in FIG. 17, fluid passages 301,302 are made through a wall of base end 11 of rod base 10. Rod base 10, rod extension 20, are arranged to form fluid annular chambers 310,325 within rod base 10 in such a way that, by selectively entering fluid into one of first and second fluid passages 301,302 and allowing fluid to flow out through the other fluid passage, rod extension 20 is caused to retract into rod base 10 or to elongate out of rod base 10. Moreover, fluid chambers 310,325 are arranged such that by blocking fluid within them, rod extension 20 remains locked at a desired length.

To this purpose, the pneumatic or hydraulic actuation means may comprise a command valve system, not shown, arranged to allow the fluid to enter into first fluid passage 301 or into second fluid passage 302, or to block both fluid passages 301,302 so that fluid is blocked within fluid chambers 310,325, and rod extension 20 remain blocked at a desired length. The command valve system may comprise one or more valves in an arrangement that is obvious for a skilled person, therefore it will not be discussed any further.

In the embodiment shown in FIG. 17, the rod extension 20 slidingly and tightly engages the inner wall of the rod base 10 and the outer boundary of the flange 320. Said rod extension 20 has a flanged portion 315 slidingly and tightly engaging with outer cylindrical wall of the internal tube 311 and the inner wall of the rod base 10. The flange 320 is connected to the internal tube 311 which is connect to the base end 11 of the rod base 10 being so part of the stationary part of this embodiment.

So, annular fluid chamber 310 is confined by the internal wall of the barrel base 10, by the base end 11, by the outer wall of the internal tube 311 and by the sliding flange 315 fixed to the sliding rod 20; Annular fluid chamber 325 is confined by the internal wall of the sliding rod 20, by the flange 320 fixed to the internal tube 311, by the outer wall of the internal tube 311 and by the sliding flange 315 fixed to the sliding rod 20.

Annular chamber 310 is provided communicating with fluid passage 302, and annular chamber 325 is provided communicating, by means of the internal tube 311 and the opening 303, with fluid passage 301.

By blowing fluid into fluid passage 301, when passage 302 is not blocked, fluid pushes against the left drawing face of the flange 315 causing a rearward slide movement of rod extension 20 with respect to rod base 10, therefore rod extension 20 retracts within rod base 10 and, accordingly, telescopic rod 400 shortens. On the other hand, by blowing fluid into fluid passage 302, when passage 301 is not blocked, fluid pushes against a base-side face of flange portion 315 causing a forward slide movement of rod extension 20 with respect to rod base 10, therefore rod extension 20 is pushed forward out of rod base 10, and, accordingly, telescopic rod 400 lengthens. If fluid is blocked within annular fluid chamber 310 and annular fluid chamber 325, for instance by blocking both fluid passages 301,302 by the command valve, extension rod 20 remains fixed at a corresponding position with respect to rod base 10, and telescopic rod 400 remains at a corresponding desired elongation. Flanges 315 and 320 are provided with proper and not described sealing means to permit the fluid tight and sliding engagement and keep the fluid within the chambers in order to avoid losses and to maintain the desired elongation during the use of the rod.

An anti-rotation means can be provided arranged to prevent a rotation of the rod extension with respect to the rod base.

In a first embodiment, not shown, the anti-rotation means comprises a protrusion or a recess made along rod extension, and a recess or a protrusion, respectively, made along rod base, that engage with each other avoiding a relative rotation of the rod extension with respect to the rod base.

Figure 18:
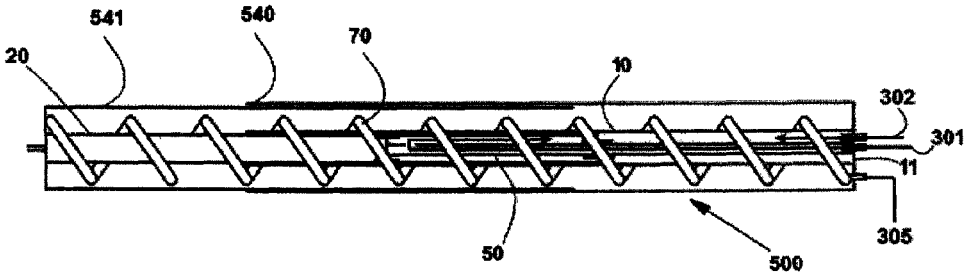
FIGS. 18-19 show an anti-rotation system for the pneumatic or hydraulic version of the telescopic rod of FIG. 17.
Figure 19:
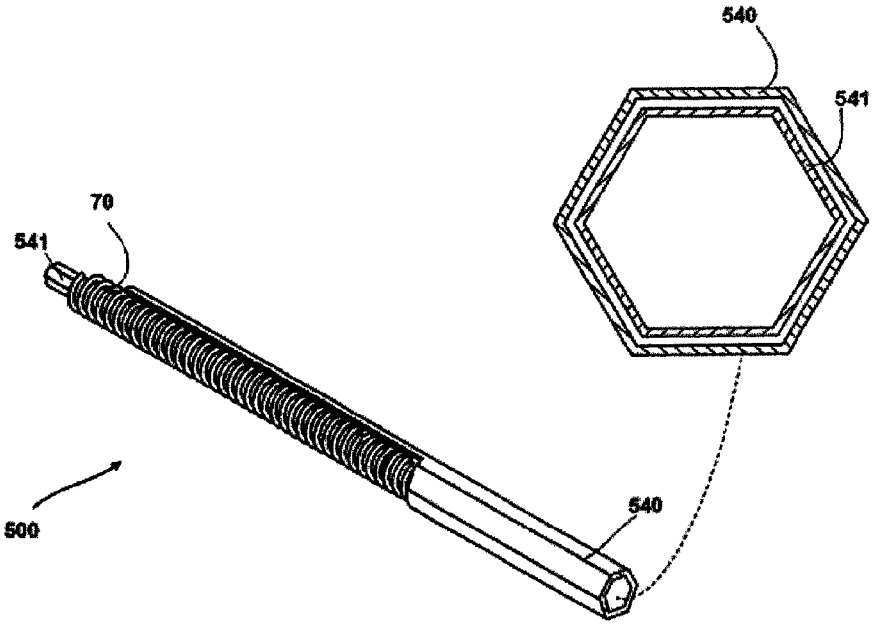

In a second embodiment, with reference to FIGS. 18 to 19, the anti-rotation means comprises a telescopic rod 500 still equipped with a pneumatic or hydraulic actuation means of the type described with reference to telescopic rod 400 of FIG. 17. Telescopic rod 500 comprises a base casing 540 and an extension casing 541, integral to rod base 10 and, respectively, to rod extension 20. More in detail, base casing 540 and extension casing 541 are arranged in such a way to engage telescopically one with each other, in order to guide the rod extension and the rod base and to avoid any rotation of the rod extension with respect to the rod base. In particular, the base casing and the extension casing can have a longitudinal protrusion/recess engaging one with each other, or have, preferably, a shaped cross-section, for example hexagonal, by which reciprocal rotation is impeded.

To connect the supported tool to a power source, an electric or pneumatic or hydraulic connection is also shown, which advantageously can be a coil arranged outside the internal actuation means and inside the base casing 540 and the extension casing 541.

The foregoing description of exemplary embodiments will so fully reveal the invention according to the conceptual point of view, so that others, by applying current knowledge, will be able to modify and/or adapt for various applications such embodiment without further research and without parting from the invention, and, then it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology that is employed herein is for the purpose of description and not of limitation.

The invention claimed is:

1. A telescopic rod configured to handle an object or a tool at a desired height above the head of a user, comprising:

a rod base having a base end;

a rod extension slidingly engaging with said rod base;

an actuation unit arranged to push/pull said rod extension with respect to said rod base;

a support member arranged at a support end of said rod extension opposite to said rod base, said support member being configured to support the tool;

a rod actuation command arranged at said base end to operate said actuation unit;

wherein said actuation unit comprises:

a nut element integral to said rod extension, and a longitudinal screw member that pivotally engages with said rod base;

a motor means that causes said screw member to rotate upon operation by said rod actuation command;

wherein said nut element is arranged to slide within said rod base and to engage with said screw member in such a way that, upon rotation of said screw member, said rod extension slides within said rod base; and wherein said rod base has a longitudinal channel in which said screw member engages with a predetermined play, wherein said longitudinal channel has a polygonal-shaped cross-section.

2. The telescopic rod according to claim 1, wherein said polygonal-shaped cross-section of said longitudinal channel is a triangular cross-section.

3. The telescopic rod according to claim 1, wherein said polygonal-shaped cross-section of said longitudinal channel is a square cross-section.

4. The telescopic rod according to claim 1, wherein said polygonal-shaped cross-section of said longitudinal channel is configured relative to said screw member in such a way that said longitudinal channel has an inner size corresponding to an outer diameter of said screw member with said predetermined play.

5. The telescopic rod according to claim 4, wherein said predetermined play provides said inner size that is greater than the outer diameter of said screw member from 0.5 mm to 4 mm.

6. The telescopic rod according to claim 4, wherein said predetermined play provides said inner size that is greater than the outer diameter of said screw member from 1 mm to 2 mm.

7. The telescopic rod according claim 1, wherein said rod base has a tubular shape with an inner longitudinal chamber, and said nut element has a collar for embracing said rod extension, and said collar slides within said inner longitudinal chamber of said rod base.

8. The telescopic rod according to claim 7, wherein said nut element is connected to the rod extension by a neck, and, between said longitudinal channel and said inner longitudinal chamber of said rod base, a groove is provided in which said neck slides.

9. The telescopic rod according to claim 7, wherein said groove has a width less than the diameter of said screw member.

10. The telescopic rod according to claim 1, further comprising an electric, pneumatic, or hydraulic connection to connect the supported tool to a power source, said electric, pneumatic, or hydraulic connection comprising a coil arranged outside said actuation unit, and inside a base casing and an extension casing.

11. The telescopic rod according to claim 1, wherein said rod actuation command is arranged to operate said actuation unit between:

a push position, in which said actuation unit pushes said rod extension with respect to said rod base in order to elongate said telescopic rod;

a pull position, in which said actuation unit pulls said rod extension with respect to said rod base in order to shorten said telescopic rod; and a standby position in which said actuation unit is inoperative, and said telescopic rod can be used at a desired rod length to maneuver said tool at a desired height.

12. The telescopic rod according to claim 1, wherein said support member is configured to support the tool, wherein said tool is selected from the group consisting of an electric tool, a pneumatic tool, and a hydraulic tool, and an extensible connection is arranged between said base end and said support end in order to provide a power supply at said support end to power said tool at any relative position between said rod extension and said rod base.

13. The telescopic rod according to claim 12, wherein a tool command is provided, by a connection at said base end connected to said extensible connection, to turn on or turn off said tool.

14. The telescopic rod according to claim 13, wherein the tool command is arranged at said base end.

15. The telescopic rod according to claim 1, comprising a base casing integral with said rod base, and an extension casing integral with said rod extension.

16. A telescopic rod configured to handle an object or a tool at a desired height above the head of a user, comprising:

a rod base having a base end;

a rod extension slidingly engaging with said rod base;

an actuation unit arranged in order to push/pull said rod extension with respect to said rod base;

a support member arranged at a support end of said rod extension opposite to said rod base, said support member being configured to support the tool;

a rod actuation command arranged at said base end to operate said actuation unit;

wherein said actuation unit comprises a tendon that has anchoring points fixed by means of a connection support to said rod extension, wherein an idle pulley and a motorized pulley are provided, which pivotally engage with said rod base, and a housing is provided within said rod base to house said pulleys.

17. A telescopic rod configured to handle an object or a tool at a desired height above the head of a user, comprising:

a rod base having a base end;

a rod extension slidingly engaging with said rod base;

an actuation unit arranged in order to push/pull said rod extension with respect to said rod base;

a support member is arranged at a support end of said rod extension opposite to said rod base, said support member configured to support the tool;

a rod actuation command arranged at said base end to operate said actuation unit;

wherein said actuation unit, the rod base, and the rod extension form a pneumatic or hydraulic actuation unit, with a first fluid passage and a second fluid passage in said rod base, wherein fluid is selectively entered into said first fluid passage, or into said second fluid passage, wherein said rod base and said rod extension are arranged in such a way that fluid selectively entered into said first fluid passage or into said second fluid passage causes a relative movement of said rod extension with respect to said rod base in order to elongate or to shorten said telescopic rod.

18. The telescopic rod according to claim 17, wherein:

said rod base has an annular chamber communicating with said first fluid passage and an outer annular chamber communicating with said second fluid passage;

said rod base comprises an inner tube defining an inner wall of said annular chamber, and an inner cylindrical wall defining an outer wall of said annular chamber, and within which said rod extension slidingly and tightly engages;

said rod extension has a flanged portion slidingly and tightly engaging with said inner cylindrical wall of said rod base;

into said annular chamber, an opening is made in said inner tube at an end of said inner tube opposite to said first and second fluid passages;

a flange connected to the inner tube wherein the fluid selectively entered into said first or said second passage causes said telescopic rod to shorten, or to elongate, or to lock fluid in said annular chambers, causing said telescopic rod to remain locked at a desired length.

19. The telescopic rod according to claim 18, comprising an anti-rotation means arranged to prevent a rotation of the rod extension with respect to the rod base.

20. The telescopic rod according to claim 19, wherein said anti-rotation means is a protrusion, or a recess made along an external wall of the rod extension, and a recess, or a protrusion, respectively, made along an inner wall of the rod base, the protrusion and the recess adapted to engage with each other and to avoid a relative rotation of the rod extension with respect to the rod base.

21. The telescopic rod according to claim 19, wherein said anti-rotation means comprises the telescopic rod having the pneumatic or hydraulic actuation unit.

* * * * *